US011844396B2

(12) United States Patent
Chan et al.

(10) Patent No.: US 11,844,396 B2
(45) **Date of Patent: *Dec. 19, 2023**

(54) AIRBAG FOR ARTICLE OF FOOTWEAR

(71) Applicant: NIKE, Inc., Beaverton, OR (US)

(72) Inventors: Wesley K. Chan, Portland, OR (US); Zachary M. Elder, Portland, OR (US); Paul Hooper, Vancouver, WA (US); Elizabeth Langvin, Sherwood, OR (US); Cassidy R. Levy, West Linn, OR (US); Philip Woodman, Treviso (IT)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/734,567

(22) Filed: May 2, 2022

(65) Prior Publication Data

US 2022/0256971 A1 Aug. 18, 2022

Related U.S. Application Data

(63) Continuation of application No. 17/133,732, filed on Dec. 24, 2020.

(Continued)

(51) Int. Cl.
*A43B 13/18* (2006.01)
*A43B 13/20* (2006.01)

(Continued)

(52) U.S. Cl.
CPC ..... *A43B 13/186* (2013.01); *A43B 7/1415* (2013.01); *A43B 13/127* (2013.01); *A43B 13/188* (2013.01); *A43B 13/206* (2013.01)

(58) Field of Classification Search
CPC ... A43B 13/186; A43B 13/127; A43B 13/188; A43B 13/206; A43B 13/20;

(Continued)

(56) References Cited

U.S. PATENT DOCUMENTS 1,468,072 A 9/1923 Millas
4,817,304 A 4/1989 Parker et al.

(Continued)

FOREIGN PATENT DOCUMENTS

CN 109068795 A 12/2018
EP 0893074 A2 1/1999

(Continued)

OTHER PUBLICATIONS

European Patent Office (ISA), International Search Report and Written Opinion for PCT App. No. PCT/US2022/023362, dated Jun. 21, 2022.

(Continued)

*Primary Examiner* — Jameson D Collier
(74) *Attorney, Agent, or Firm* — Honigman LLP; Matthew H. Szalach; Jonathan P. O'Brien

(57) ABSTRACT

A fluid-filled chamber includes first subchamber having a substantially U-shape. The fluid-filled chamber also includes a second subchamber having a substantially U-shape and being spaced apart from the first subchamber in a direction extending along a longitudinal axis of the fluid-filled chamber.

20 Claims, 6 Drawing Sheets

Related U.S. Application Data

(60) Provisional application No. 62/955,120, filed on Dec. 30, 2019.

(51) Int. Cl.
*A43B 7/1415* (2022.01)
*A43B 13/12* (2006.01)

(58) Field of Classification Search
CPC ... A43B 13/189; A43B 13/203; A43B 3/0063; A43B 7/141; A43B 7/1415
USPC ..... 36/29; 428/34.1
See application file for complete search history.

(56) References Cited

U.S. PATENT DOCUMENTS

| | | | | |
|---|---|---|---|---|
| 5,406,719 | A * | 4/1995 | Potter | A43B 13/203 36/35 B |
| D364,036 | S | 11/1995 | Passke et al. | |
| 5,595,004 | A | 1/1997 | Lyden et al. | |
| 5,713,141 | A * | 2/1998 | Mitchell | B32B 33/00 36/71 |
| 5,952,065 | A * | 9/1999 | Mitchell | B32B 33/00 428/424.2 |
| 5,987,780 | A | 11/1999 | Lyden et al. | |
| 6,253,466 | B1 * | 7/2001 | Harmon-Weiss | A43B 13/206 36/35 R |
| 6,582,786 | B1 * | 6/2003 | Bonk | A43B 13/206 428/476.3 |
| 6,971,193 | B1 * | 12/2005 | Potter | A43B 13/203 36/141 |
| 7,451,555 | B1 * | 11/2008 | Lakic | A43B 13/206 36/43 |
| 10,149,513 | B1 | 12/2018 | Eldem et al. | |
| 2006/0086003 | A1 | 4/2006 | Tseng | |
| 2012/0174432 | A1 | 7/2012 | Peyton | |
| 2012/0324762 | A1 | 12/2012 | Soumokil et al. | |
| 2014/0230276 | A1 | 8/2014 | Campos, II et al. | |
| 2015/0272271 | A1 | 10/2015 | Campos, II et al. | |
| 2016/0073732 | A1 | 3/2016 | Ernst et al. | |
| 2016/0120263 | A1 * | 5/2016 | Cortez | A43B 3/0063 36/29 |
| 2017/0119096 | A1 | 5/2017 | Greene | |
| 2017/0265564 | A1 | 9/2017 | Peyton | |
| 2017/0265566 | A1 | 9/2017 | Case et al. | |
| 2019/0380435 | A1 | 12/2019 | Campos, II et al. | |
| 2020/0022454 | A1 | 1/2020 | Eldem et al. | |

FOREIGN PATENT DOCUMENTS

| | | | |
|---|---|---|---|
| EP | 1109468 | A1 | 6/2001 |
| KR | 20020014022 | A | 2/2002 |
| KR | 20120130542 | A | 12/2012 |
| WO | WO-9807343 | A1 | 2/1998 |
| WO | WO-2017160946 | A1 | 9/2017 |

OTHER PUBLICATIONS

European Patent Office (ISA), International Search Report and Written Opinion for PCT App. No. PCT/US2022/023367, dated Jun. 22, 2022.
United States Patent and Trademark Office, Non-Final Office Action for U.S. Appl. No. 17/734,717 dated Jul. 1, 2022.
United States Patent and Trademark Office, Non-Final Office Action for U.S. Appl. No. 17/734,798 dated Jul. 18, 2022.
European Patent Office (ISA), International Search Report and Written Opinion for International Application No. PCT/US2022/023371, dated Aug. 19, 2022.
China National Intellectual Property Administration, First Office Action for CN App. No. 202080031513.2, dated Aug. 29, 2022.
European Patent Office as ISA, International Search Report and Written Opinion for App. No. PCT/US2020/067141, dated Mar. 29, 2021.

* cited by examiner

AIRBAG FOR ARTICLE OF FOOTWEAR

CROSS REFERENCE TO RELATED APPLICATION

This application is a continuation of U.S. patent application Ser. No. 17/133,732, filed Dec. 24, 2020, which claims priority under 35 U.S.C. § 119(e) to Provisional U.S. Patent Application No. 62/955,120, filed Dec. 30, 2019, the disclosures of which are hereby incorporated by reference in their entireties.

FIELD

The present disclosure relates generally to sole structures for articles of footwear, and more particularly, to sole structures incorporating a fluid-filled bladder.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally or alternatively incorporate a fluid-filled bladder to increase durability of the sole structure, as well as to provide cushioning to the foot by compressing resiliently under an applied load to attenuate ground-reaction forces. Sole structures may also include a comfort-enhancing insole or a sockliner located within a void proximate to the bottom portion of the upper and a strobel attached to the upper and disposed between the midsole and the insole or sockliner.

Midsoles employing fluid-filled bladders typically include a bladder formed from two barrier layers of polymer material that are sealed or bonded together. The fluid-filled bladders are pressurized with a fluid such as air, and may incorporate tensile members within the bladder to retain the shape of the bladder when compressed resiliently under applied loads, such as during athletic movements. Generally, bladders are designed with an emphasis on balancing support for the foot and cushioning characteristics that relate to responsiveness as the bladder resiliently compresses under an applied load

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
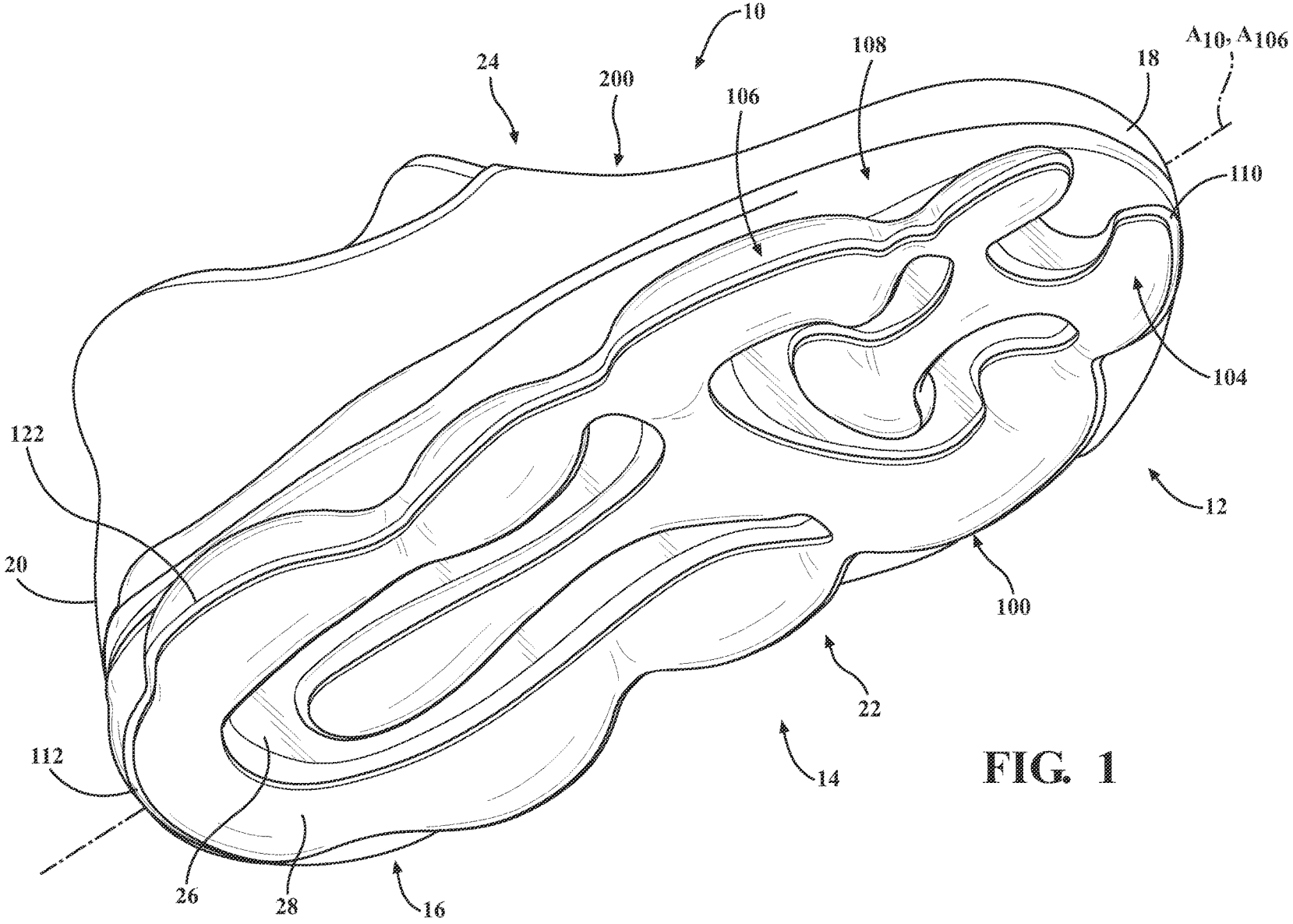
FIG. 1 is a perspective view of an article of footwear in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides a bladder. The bladder includes a first chamber having a substantially U-shape. The bladder also includes a second chamber having a substantially U-shape and being spaced apart from the first chamber in a direction extending along a longitudinal axis of the bladder.

Implementations of the disclosure may include one or more of the following optional features. In some implementations, the first chamber and the second chamber are in fluid communication with one another. The first chamber may be aligned with the second chamber.

In some examples, the first chamber includes a first leg and a second leg joined by a first arcuate segment and the second chamber includes a third leg and a fourth leg joined by a second arcuate segment. The first leg, the second leg, the third leg, and the fourth leg may extend in the same direction. The first leg and the second leg may be disposed between the first arcuate segment and the second arcuate segment. At least one of the first leg, the second leg, the third leg, and the fourth leg may be elongate. The bladder may include a third chamber extending between the first leg and the second leg in a direction toward the first arcuate segment. The third chamber may be spaced apart from the first leg and the second leg. The bladder may include a fourth chamber extending between the third leg and the fourth leg in a direction toward the second arcuate segment. The fourth chamber may be spaced apart from the third leg and the fourth leg. At least one of the third chamber and the fourth chamber may be elongate.

In some configurations, the bladder includes a web area defining the first chamber and the second chamber. The web area may include a first portion having a substantially U-shape and a second portion having a substantially U-shape. An article of footwear may incorporate the bladder.

Another aspect of the disclosure provides a bladder. The bladder includes a first chamber and a second chamber spaced apart from the first chamber in a direction extending along a longitudinal axis of the bladder. The bladder also includes a web area defining the first chamber and the second chamber and including a first portion having a substantially U-shape and a second portion having a substantially U-shape.

Implementations of the disclosure may include one or more of the following optional features. In some implementations, the first chamber and the second chamber are in fluid communication with one another. The first chamber may include a substantially U-shape and the second chamber may include a substantially U-shape. Here, the first chamber is aligned with the second chamber.

In some examples, the first chamber includes a first leg and a second leg joined by a first arcuate segment, and the second chamber includes a third leg and a fourth leg joined by a second arcuate segment. Here, the first leg, the second leg, the third leg, and the fourth leg may extend in the same direction. Optionally, the first leg and the second leg may be disposed between the first arcuate segment and the second arcuate segment. At least one of the first leg, the second leg, the third leg, and the fourth leg may be elongate. The bladder may include a third chamber extending between the first leg and the second leg in a direction toward the first arcuate segment. Here, the third chamber may be spaced apart from the first leg and the second leg. Optionally, the bladder may include a fourth chamber extending between the third leg and the fourth leg in a direction toward the second arcuate segment. The fourth chamber may be spaced apart from the third leg and the fourth leg. At least one of the third chamber and the fourth chamber may be elongate. An article of footwear may incorporate the bladder.

Referring to FIGS. 1-8, an article of footwear 10 includes a sole structure 100 and an upper 200 attached to the sole structure 100. The article of footwear 10 may be divided into one or more regions. The regions may include a forefoot region 12, a mid-foot region 14, and a heel region 16. The forefoot region 12 may be further described as including a toe portion $\mathbf{12}_T$ corresponding to the phalanges of the foot, and a ball portion $\mathbf{12}_B$ corresponding to a metatarsophalangeal (MTP) joint. The mid-foot region 14 may correspond with an arch area of the foot, and the heel region 16 may correspond with rear portions of the foot, including a calcaneus bone. The footwear 10 may further include an anterior end 18 associated with a forward-most point of the forefoot region 12, and a posterior end 20 corresponding to a rearward-most point of the heel region 16. A longitudinal axis $A_{10}$ of the footwear 10 extends along a length of the footwear 10 from the anterior end 18 to the posterior end 20, and generally divides the footwear 10 into a medial side 22 and a lateral side 24, as shown in FIG. 1. Accordingly, the medial side 22 and the lateral side 24 respectively correspond with opposite sides of the footwear 10 and extend through the regions 12, 14, 16.

The article of footwear 10, and more particularly, the sole structure 100, may be further described as including an interior region 26 and a peripheral region 28, as indicated in FIG. 1. The peripheral region 28 is generally described as being a region between the interior region 26 and an outer perimeter of the sole structure 100. Particularly, the peripheral region 28 extends from the forefoot region 12 to the heel region 16 along each of the medial side 22 and the lateral side 24, and wraps around each of the forefoot region 12 and the heel region 16. Thus, the interior region 26 is circumscribed by the peripheral region 28, and extends from the forefoot region 12 to the heel region 16 along a central portion of the sole structure 100.

Figure 2:
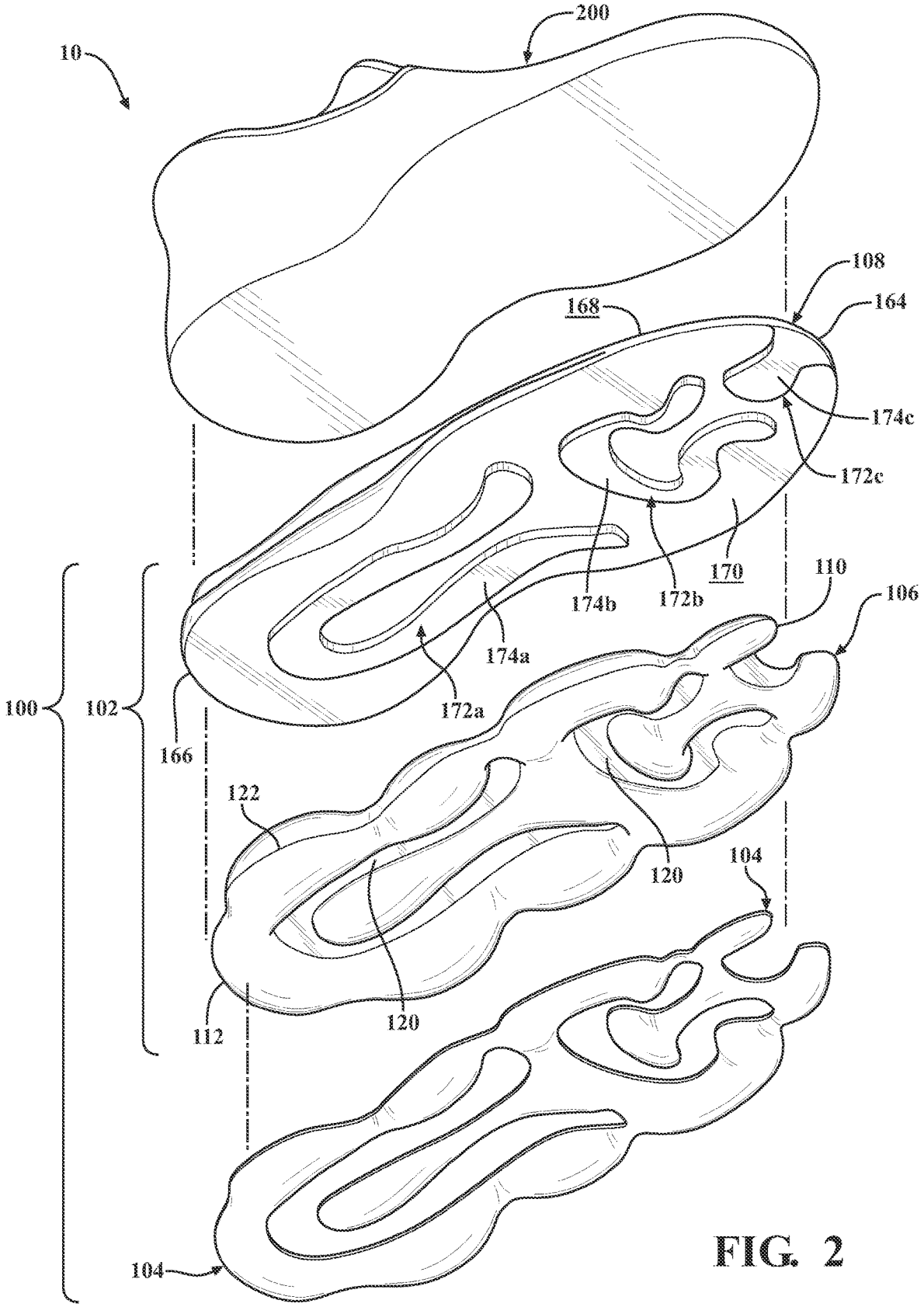
FIG. 2 is an exploded view of the article of footwear of FIG. 1, showing an article of footwear having an upper and a sole structure arranged in a layered configuration.

With reference to FIG. 2, the sole structure 100 includes a midsole 102 configured to provide cushioning characteristics to the sole structure 100, and an outsole 104 configured to provide a ground-engaging surface of the article of footwear 10. Unlike conventional sole structures, the midsole 102 of the sole structure 100 may be formed compositely and include a plurality of subcomponents for providing desired forms of cushioning and support throughout the sole structure 100. For example, the midsole 102 includes a bladder 106 and a chassis 108, where the chassis 108 is attached to the upper 200 and provides an interface between the upper 200 and the bladder 106.

With reference to FIGS. 1-5, a longitudinal axis $A_{106}$ of the bladder 106 extends from a first end 110 in the forefoot region 12 to a second end 112 in the heel region 16. The bladder 106 may be further described as including a top surface or side 114 and a bottom surface or side 116 formed on an opposite side of the bladder 106 from the top side 114. As discussed in greater detail below with respect to FIGS. 6-8, a thicknesses $T_{106}$ of the bladder 106, or of elements of the bladder 106, are defined by a distance from the top side 114 to the bottom side 116.

Figure 6:
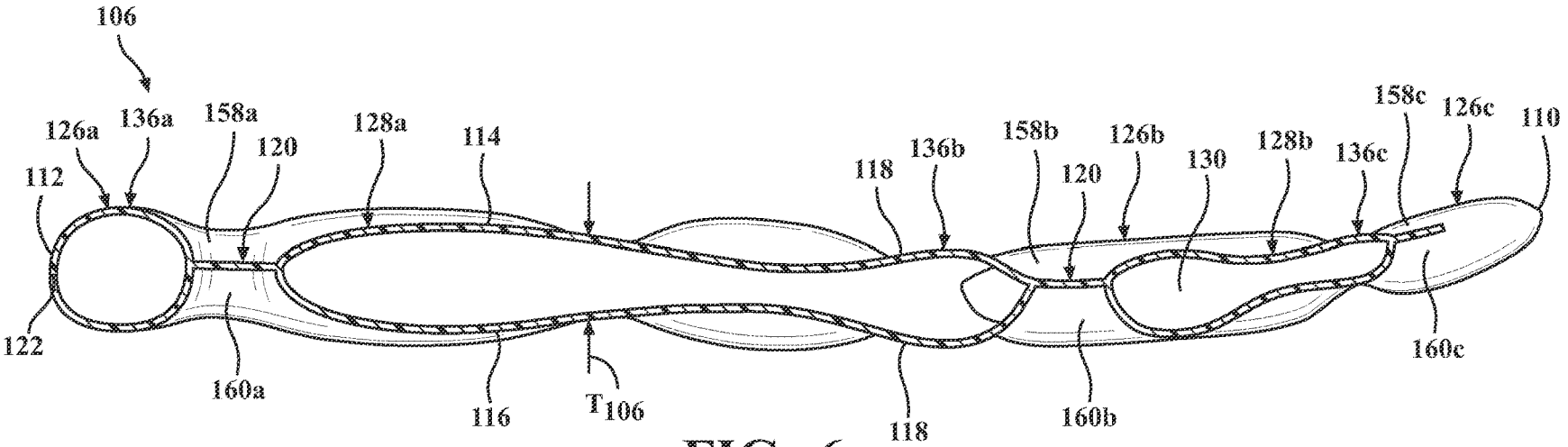
FIG. 6 is a cross-sectional view of the bladder of FIG. 3 taken along Line 6-6 of FIG. 5.
Figure 8:
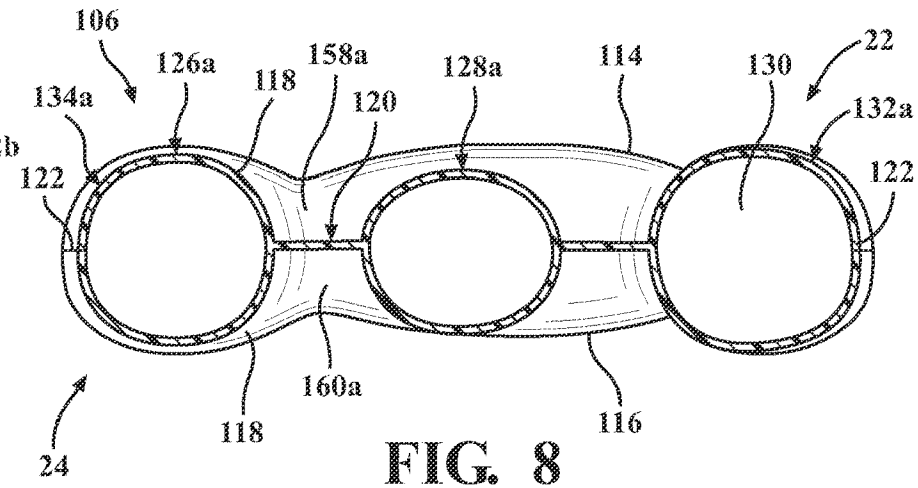
FIG. 8 is a cross-sectional view of the bladder of FIG. 3 taken along Line 8-8 of FIG. 5.
Figure 7:
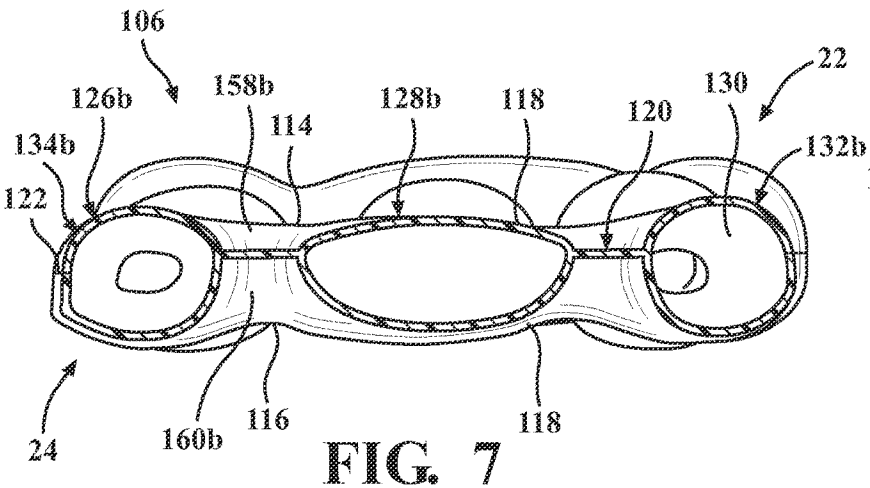
FIG. 7 is a cross-sectional view of the bladder of FIG. 3 taken along Line 7-7 of FIG. 5.

As shown in the cross-sectional views of FIGS. 6-8, the bladder 106 may be formed by an opposing pair of barrier layers 118, which can be joined to each other at discrete locations to define an overall shape of the bladder 106. Alternatively, the bladder 106 can be produced from any suitable combination of one or more barrier layers. As used herein, the term "barrier layer" (e.g., barrier layers 118) encompasses both monolayer and multilayer films. In some embodiments, one or both of the barrier layers 118 are each produced (e.g., thermoformed or blow molded) from a monolayer film (a single layer). In other embodiments, one or both of the barrier layers 118 are each produced (e.g., thermoformed or blow molded) from a multilayer film (multiple sublayers). In either aspect, each layer or sublayer can have a film thickness ranging from about 0.2 micrometers to about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of the barrier layers 118 can independently be transparent, translucent, and/or opaque. As used herein, the term "transparent" for a barrier layer and/or a bladder means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers 118 can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4, 4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials, as well as with the TPU copolymers described herein and optionally including combinations of polyimides and crystalline polymers, are also suitable.

The barrier layers 118 may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entireties. In embodiments where the barrier layers 118 include two or more sublayers, examples of suitable multilayer films include microlayer films, such as those disclosed in Bonk et al., U.S. Pat. No. 6,582,786, which is incorporated by reference in its entirety. In further embodiments, the barrier layers 118 may each independently include alternating sublayers of one or more TPU copolymer materials and one or more EVOH copolymer materials, where the total number of sublayers in each of the barrier layers 118 includes at least four (4) sublayers, at least ten (10) sublayers, at least twenty (20) sublayers, at least forty (40) sublayers, and/or at least sixty (60) sublayers.

The bladder 106 can be produced from the barrier layers 118 using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier layers 118 can be produced by co-extrusion followed by vacuum thermoforming to form the profile of the bladder 106, which can optionally include one or more valves 121 (e.g., one way valves) that allows the bladder 106 to be filled with the fluid (e.g., gas).

The bladder 106 desirably has a low gas transmission rate to preserve its retained gas pressure. In some embodiments, the bladder 106 has a gas transmission rate for nitrogen gas that is at least about ten (10) times lower than a nitrogen gas transmission rate for a butyl rubber layer of substantially the same dimensions. In an aspect, bladder 106 has a nitrogen gas transmission rate of 15 cubic-centimeter/square-meter·atmosphere·day ($cm^3/m^2 \cdot atm \cdot day$) or less for an average film thickness of 500 micrometers (based on thicknesses of barrier layers 118). In further aspects, the transmission rate is 10 $cm^3/m^2 \cdot atm \cdot day$ or less, 5 $cm^3/m^2 \cdot atm \cdot day$ or less, or 1 $cm^3/m^2 \cdot atm \cdot day$ or less.

In the shown embodiment, the barrier layers 118 include a first, upper barrier layer 118 forming the top side 114 of the bladder 106, and a second, lower barrier layer 118 forming the bottom side 116 of the bladder 106. In the illustrated example, interior, opposing surfaces (i.e. facing each other) of the barrier layers 118 are joined together at discrete locations to form a web area 120 and a peripheral seam 122. The peripheral seam 122 extends around the outer periphery of the bladder 106 and defines an outer peripheral profile of the bladder 106. As shown in FIGS. 3-8, the upper and lower barrier layers 118 are spaced apart from each other between the web area 120 and the peripheral seam 122 to define a plurality of chambers 126*a*-126*c*, 128*a*-128*b* each forming a respective portion of an interior void 130 of the bladder 106.

In the illustrated example, the bladder 106 includes a plurality of U-shaped or horseshoe-shaped chambers 126*a*-126*c*. As discussed in greater detail below, portions of these chambers 126*a*-126*c* extend along the medial and lateral sides 22, 24 in the peripheral region 28. Accordingly, these chambers 126*a*-126*b* may be referred to as peripheral chambers 126*a*-126*c*. The peripheral chambers 126*a*-126*c* include a heel peripheral chamber 126*a*, a forefoot peripheral chamber 126*b*, and a toe peripheral chamber 126*c*, where the forefoot peripheral chamber 126*b* is disposed between the heel peripheral chamber 126*a* and the toe peripheral chamber 126*c* and is smaller than the heel peripheral chamber 126*a* and larger than the toe peripheral chamber 126*c*. Generally, the peripheral chambers 126*a*-126*c* are arranged in series along the longitudinal axis $A_{106}$ from the first end 110 of the bladder 106 to the second end 112 of the bladder 106. Accordingly, the chambers 126*a*-126*c* are aligned with each other along the direction of the length of the bladder 106.

Each of the peripheral chambers 126*a*-126*c* may be described as including a medial elongate segment or leg 132*a*-132*c* extending along the medial side 22 of the bladder 106 in the peripheral region 28, a lateral elongate segment or leg 134*a*-134*c* extending along the lateral side 24 of the bladder 106 in the peripheral region 28, and an intermediate segment 136*a*-136*c* extending across the interior region 26 and connecting the medial leg 132*a*-132*c* to the lateral leg 134*a*-134*c*. As shown, the intermediate segment 136*a*-136*c* of each of the peripheral chambers 126*a*-126*c* may extend along an arcuate path from the medial side 22 to the lateral side 24. Here, each of the medial legs 132*a*-132*c* extends from the respective intermediate segment 136*a*-136*c* in a direction along the longitudinal axis $A_{106}$ to a medial end 138*a*-138*c* on the medial side 22 of the bladder 106, and each of the lateral legs 134*a*-134*c* extends from the respective intermediate segment 136*a*-136*c* in a direction along the longitudinal axis $A_{106}$ to a lateral end 140*a*-140*c* on the lateral side 24 of the bladder 106. Thus, the respective medial legs 132*a*-132*c* and the lateral legs 134*a*-134*c* extend along the same direction from opposite ends of the intermediate segments 136*a*-136*c*.

Figure 3:
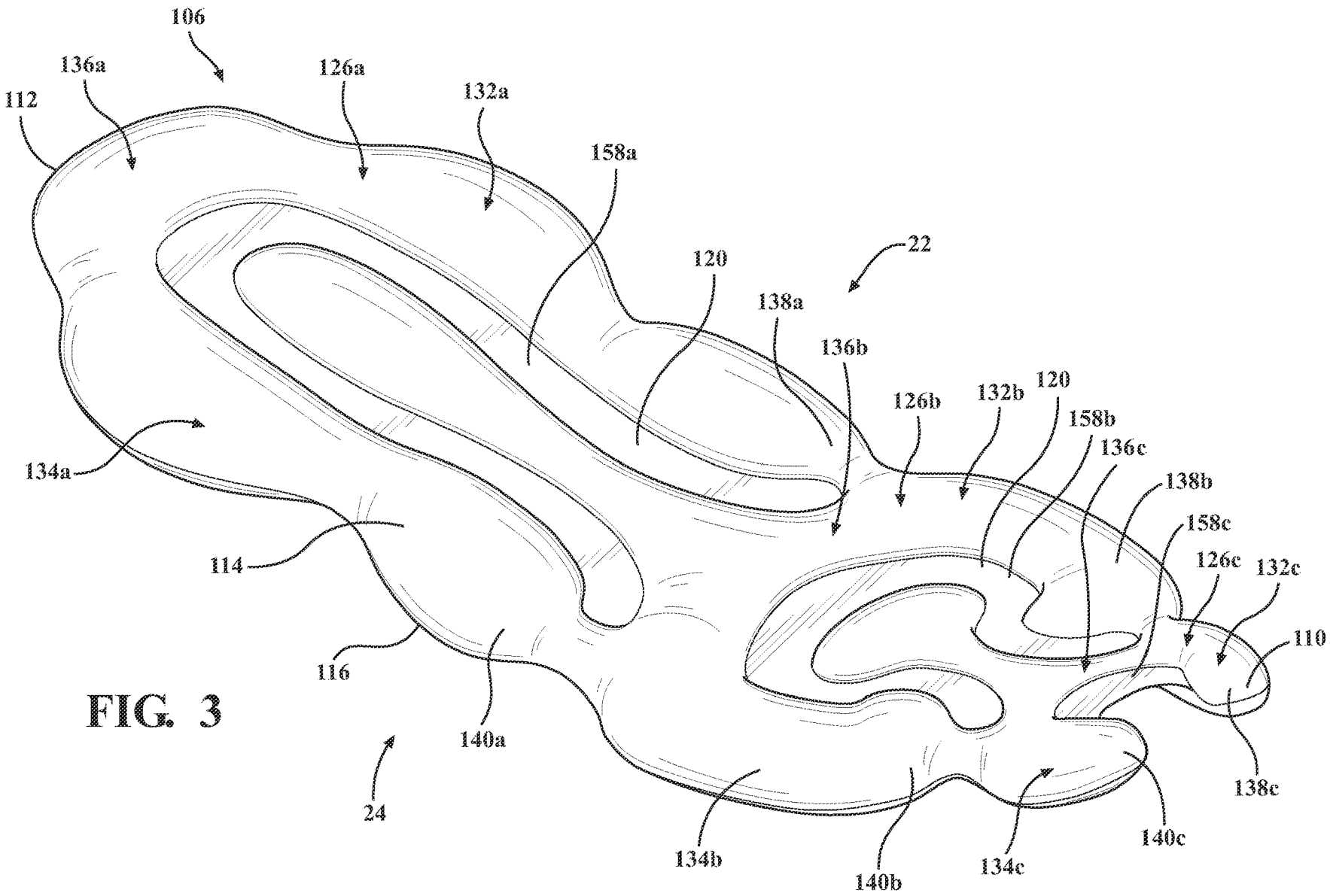
FIG. 3 is a top perspective view of a bladder in accordance with the principles of the present disclosure for use with the article of footwear of FIG. 1.
Figure 4:
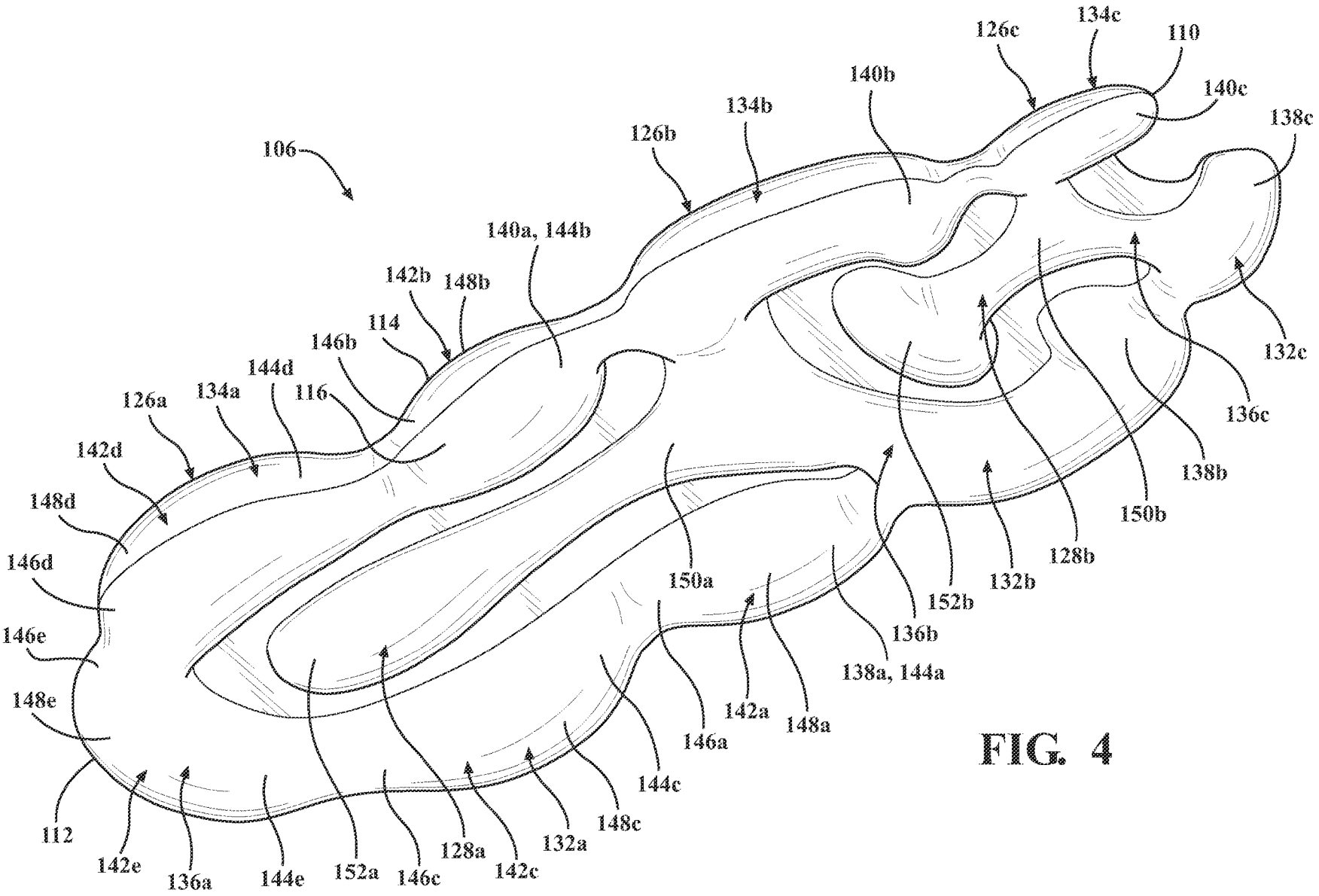
FIG. 4 is a bottom perspective view of a bladder in accordance with the principles of the present disclosure for use with the article of footwear of FIG. 1.
Figure 5:
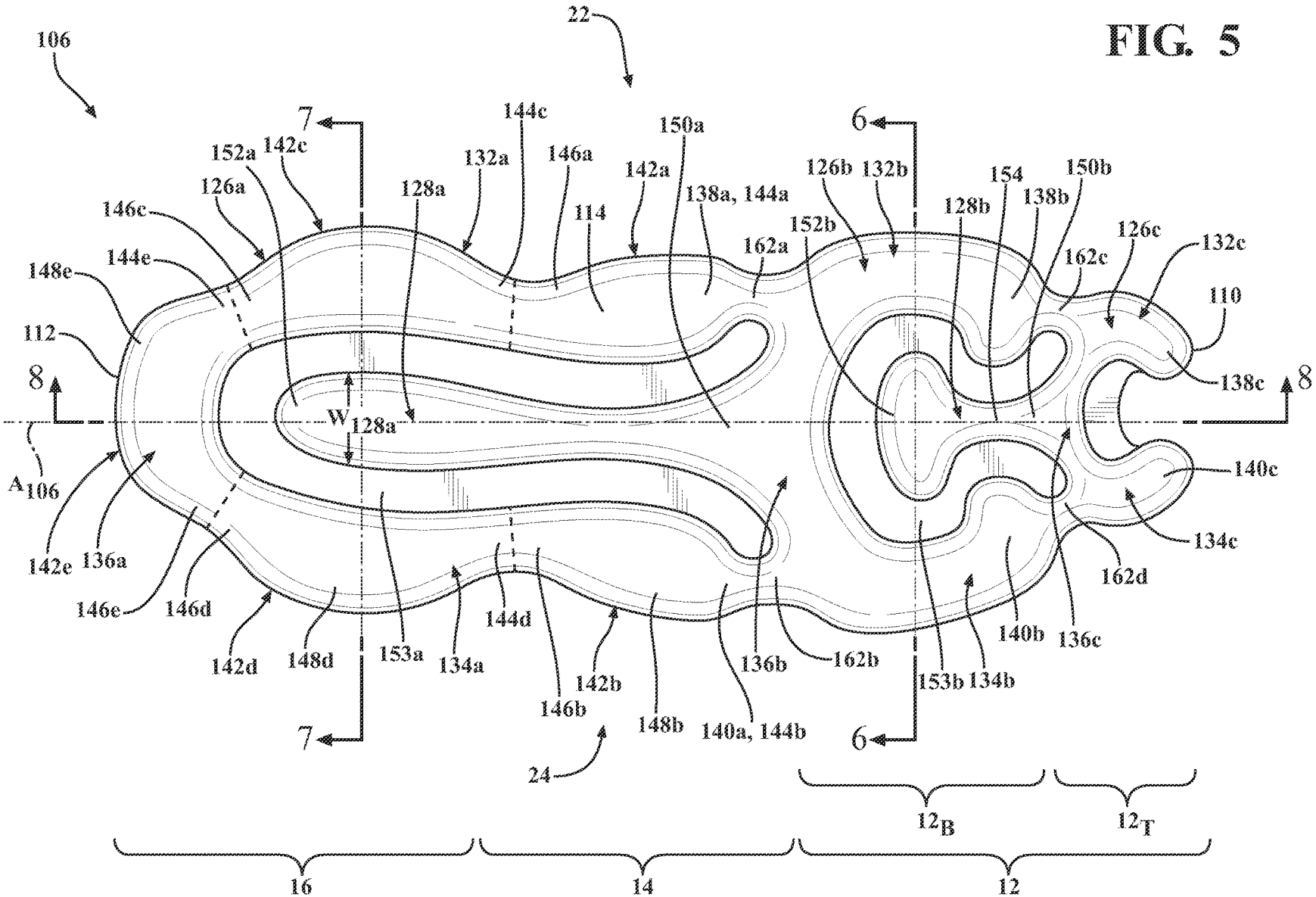
FIG. 5 is a bottom plan view of a bladder in accordance with the principles of the present disclosure for use with the article of footwear of FIG. 1

With reference to FIGS. 3-5, the heel peripheral chamber 126*a* extends through the mid-foot and heel regions 14, 16 of the bladder 106 in the peripheral region 28. Particularly, the heel peripheral chamber 126*a* includes the medial leg 132*a* extending along the medial side 22 from the medial end 138*a* adjacent to the forefoot region 14, and the lateral leg 134*a* extending along the lateral side 24 from the lateral end 140*a* adjacent to the forefoot region 14. The intermediate segment 136*c* extends around the second end 112 of the bladder 106 from the medial leg 132*a* to the lateral leg 134*a*. As discussed in greater detail below, the medial and lateral ends 138*a*, 140*a* of the heel peripheral chamber 126*a* may each be in direct fluid communication with the forefoot peripheral chamber 126*b*. In other words, the ends 138*a*, 140*a* may each be directly connected to the forefoot peripheral chamber 126*b*.

Referring to FIGS. 4 and 5, one or more of the peripheral chambers 126*a*-126*c* may have a variable cross-sectional area from end to end. As shown, the heel peripheral chamber 126*a* includes a plurality of lobes 142*a*-142*e* each forming a portion of the heel peripheral chamber 126*a* having a variable cross-sectional area. For example, each of the lobes 142*a*-142*e* includes a first end 144*a*-144*e* having a first cross-sectional area, a second end 146*a*-146*e* having a second cross-sectional area, and an intermediate portion 148*a*-148*e* disposed between the first end 144*a*-144*e* and the second end 146*a*-146*e* and having a third cross-sectional area that is greater than the first cross-sectional area and the second cross-sectional area. Accordingly, each of the lobes 142*a*-142*e* tapers towards the respective first end 144*a*-144*e* and second end 146*a*-146*e* from the intermediate portion 148*a*-148*e*. In some examples, both the width and the thickness of each of the lobes 142*a*-142*e* tapers from the intermediate portion 148*a*-148*e*.

The illustrated example of the bladder 106 includes a plurality of the lobes 142*a*-142*e* arranged end-to-end in series along the peripheral region 28 such that the cross-sectional area of the heel peripheral chamber 126*a* alternates between larger and smaller sizes. As shown, the plurality of the lobes 142*a*-142*e* includes a first pair of anterior lobes 142*a*, 142*b* at the ends 138*a*, 140*a* of the heel peripheral chamber 126*a*, a pair of intermediate lobes 142*c*, 142*d* disposed between the anterior lobes 142*a*, 142*b* and the second end 112, and a posterior lobe 142*e* disposed at the second end 112 of the bladder 106.

The anterior lobes 142*a*, 142*b* of the heel peripheral chamber 126*a* include a medial anterior lobe 142*a* disposed at the medial end 138*a* on the medial side 22 of the bladder 106, and a lateral anterior lobe 142*b* disposed at the lateral end 140*a* on the lateral side 24 of the bladder 106. Each of the anterior lobes 142*a*, 142*b* extends from its respective first end 144*a*, 144*b* and along the peripheral region 28 to its respective second end 146*a*, 146*b*.

With continued reference to FIGS. 3-5, the posterior lobe 142*e* is disposed at the second end 112 of the bladder 106 and the intermediate portion 148*e* of the posterior lobe 142*e* is aligned with the longitudinal axis $A_{106}$ of the bladder 106. In the illustrated example, the posterior lobe 142*e* extends from a first end 144*e* on the medial side 22 of the bladder 106 to a second end 146*e* on the lateral side 24 of the bladder 106. As discussed above, the intermediate portion 148*e* has a greater cross-sectional area than each of the ends 144*e*, 146*e*.

The intermediate lobes 142*c*, 142*d* of the heel peripheral chamber 126*a* include a medial intermediate lobe 142*c* disposed on the medial side 22 of the bladder 106, and a lateral intermediate lobe 142*d* disposed on the lateral side 24 of the bladder 106. As shown, first ends 144*c*, 144*d* of the intermediate lobes 142*c*, 142*d* are connected to the second ends 146*a*, 146*b* of the medial and lateral anterior lobes 142*a*, 142*b*, respectively. The second end 146*c* of the medial intermediate lobe 142*c* is connected to the first end 144*e* of the posterior lobe 142*e*. Likewise, the second end 146*d* of the lateral intermediate lobe 142*d* is connected to the second end 146*e* of the posterior lobe 142*e*. Similar to the anterior lobes 142*a*, 142*b* and the posterior lobe 142*e*, the intermediate lobes 142*c*, 142*d* provide the heel peripheral chamber 126*a* with protruding portions along the medial and lateral sides 22, 24 of the bladder 106.

Referring still to FIGS. 3-5, the forefoot peripheral chamber 126*b* extends through the ball portion $12_B$ of the forefoot region 12, and is disposed between the heel peripheral chamber 126*a* and the toe peripheral chamber 126*c*. Here, the medial leg 132*b* extends along the medial side 22 from the medial end 138*b* adjacent to the toe portion $12_T$, and the lateral leg 134*b* extends along the lateral side 24 from the lateral end 140*b* adjacent to the toe portion $12_T$. The intermediate segment 136*b* extends across the width of the bladder 106 adjacent to the mid-foot region 14 and connects the medial leg 132*b* to the lateral leg 134*b*. As shown, the intermediate segment 136*b* extends along an arcuate path from the medial side 22 to the lateral side 24.

In some examples, one or both of the ends 138*b*, 140*b* of the forefoot peripheral chamber 126*b* may be bulbous, whereby a size (e.g., cross-section, width, thickness) of the end 138*b*, 140*b* is greater than the immediately adjacent portion of the forefoot peripheral chamber 126*b*. For example, in the illustrated configuration, a width of each of the ends 138*b*, 140*b* protrudes inwardly towards the longitudinal axis $A_{106}$ of the bladder 106.

With continued reference to FIGS. 3-5, the toe peripheral chamber 126*c* extends through the toe portion $12_T$ of the forefoot region 12, and is disposed adjacent to the first end 110 of the bladder 106. Here, the medial leg 132*c* extends along the medial side 22 from the medial end 138*c* at the first end 110 of the bladder 106, and the lateral leg 134*c* extends along the lateral side 24 from the lateral end 140*c* at the first end 110 of the bladder 106. The intermediate segment 136*c* extends across the width of the bladder 106 adjacent to the ball portion $12_B$ and connects the medial leg 132*c* to the lateral leg 134*c*. The intermediate segment 136*c* extends along an arcuate path from the medial side 22 to the lateral side 24.

Unlike the heel peripheral chamber 126*a* and the forefoot peripheral chamber 126*b*, which are fully attached to the web area 120, the medial and lateral legs 132*c*, 134*c* of the toe peripheral chamber 126*c* may only be partially attached to the web area 120. For example, the medial and lateral ends 138*c*, 140*c* of the toe peripheral chamber 126*c* may project beyond the web area 120, such that each of the ends 138*c*, 140*c* is free-hanging. Accordingly, each of the ends 138*c*, 140*c* may move independent of the other. In another configuration, the ends 138*c*, 140*c* may be joined, thereby proving the toe peripheral chamber 126*c* with a substantially circular shape (not shown).

In addition to the peripheral chambers 126*a*-126*c*, the bladder 106 includes one or more interior chambers 128*a*, 128*b* disposed in the interior region 26 of the bladder 106. Here, each of the interior chambers 128*a*, 128*b* is at least partially surrounded by a respective one of the peripheral chambers 126*a*, 126*b*. Generally, each of the interior chambers 128*a*, 128*b* extends from a first end 150*a*, 150*b* connected to an intermediate segment 136*b*, 136*c* of an adjacent one of the peripheral chambers 126*b*, 126*c*, to a terminal second end 152*a*, 152*b* adjacent to the intermediate segment 136*a*, 136*b* of the respective one of the peripheral chambers 126*a*, 126*b*.

As shown in FIG. 5, a heel interior chamber 128*a* extends along the longitudinal axis $A_{106}$ from a first end 150*a* connected to the intermediate segment 136*b* of the forefoot peripheral chamber 126*b*, to a terminal second end 152*a* adjacent to the intermediate segment 136*a* of the heel peripheral chamber 126*a*. An outer perimeter of the heel interior chamber 128*a* is inwardly offset from an inner perimeter of the heel peripheral chamber 126*a* by a substantially constant distance. As such, a width of the heel interior chamber 128*a* may increase along the direction from the first end 150*a* to the second end 152*a*.

A forefoot interior chamber 128*b* extends along the longitudinal axis $A_{106}$ from a first end 150*b* connected to the intermediate segment 136*c* of the toe peripheral chamber 126*c*, to a terminal second end 152*b* adjacent to the intermediate segment 136*b* of the forefoot peripheral chamber 126*b*. As shown, an outer perimeter of the forefoot interior chamber 128*b* is inwardly offset from an inner perimeter of the forefoot peripheral chamber 126*b* by a substantially constant distance. In the illustrated example, the forefoot interior chamber 128*b* includes a necked portion 154 adjacent to the first end 150*b*, which extends between the bulbous ends 138*b*, 140*b* of the forefoot peripheral chamber 126*b*. The second end 152*b* of the forefoot interior chamber 128*b* may also be bulbous, and is circumscribed by the segments 132*b*, 134*b*, 136*b* of the forefoot peripheral chamber 126*b*.

The interior chambers 128*a*, 128*b* are attached to the respective peripheral chambers 126*a*, 126*b* by the web area 120, such that each of the interior chambers 128*a*, 128*b* is surrounded by a portion the web area 120. Accordingly, the web area 120 includes a first portion 153*a* having a substantially U-shape surrounding the heel interior chamber 128*a*, and a second portion 153*b* having a substantially U-shape surrounding the forefoot interior chamber 128*b*. As shown, the first U-shaped portion 153*a* of the web area 120 extends between and attaches the outer perimeter of the heel interior chamber 128*a* and the inner perimeter of the heel perimeter chamber 126*a*. Likewise, the second U-shaped portion 153*b* extends between and attaches the outer perimeter of the forefoot interior chamber 128*b* and the inner perimeter of the forefoot perimeter chamber 126*b*. As illustrated, with respect to the aforementioned portions of the web area 120, the term "U-shaped" is not limited strictly to shapes having two straight legs connected by a constant curvature, but instead refers to any shape the extends from a first end along a general first direction, and then turns back and extends along the first direction to a second end adjacent to or across from the first end. For example, the respective ends of the first U-shaped portion 153*a* and the second U-shaped portion 153*b* may extend away from one another. Thus, the U-shaped portions of the web area could also be described as being horseshoe-shaped, bell-shaped, or hairpin-shaped, for example.

Adjacent ones of the chambers 126*a*-126*c*, 128*a*-128*b* are separated from each other by the portions of the web area 120, such that pockets or spaces 158*a*-158*c*, 160*a*-160*c* are formed on opposite sides 114, 116 of the bladder 106 between adjacent ones of the chambers 126*a*-126*c*, 128*a*-128*b*, as best shown in FIGS. 6-8. In other words, the bladder 106 includes a series of upper pockets 158*a*-158*c* formed by the web area 120 and adjacent chambers 126*a*-126*c*, 128*a*-128*b* on the top side 114 of the bladder 106, and a series of lower pockets 160*a*-160*c* formed by the web area 120 and adjacent chambers 126*a*-126*c*, 128*a*-128*b* on the bottom side 116 of the bladder 106.

With continued reference to FIG. 5, the bladder 106 includes a plurality of conduits 162*a*-162*d* fluidly coupling adjacent ones of the peripheral chambers 126*a*-126*c* to each other. Accordingly, the portions of the interior void 130 formed by each of the peripheral chambers 126*a*-126*c* are in fluid communication with each other, such that fluid can be transferred between the peripheral chambers 126*a*-126*c*. In the illustrated example, a first pair of conduits 162*a*, 162*b* connects the ends 138*a*, 140*a* of the heel peripheral chamber 126*a* to the intermediate segment 136*b* of the forefoot peripheral chamber 126*b*, and a second pair of conduits 162*c*, 162*d* connects the ends 138*b*, 140*b* of the forefoot peripheral chamber 126*b* to the intermediate segment 136*c* of the toe peripheral chamber 126*c*.

With continued reference to FIG. 2, the chassis 108 is configured to interface with the bladder 106 to provide a unitary midsole 102. The chassis 108 extends from a first end 164 at the anterior end 18 of the sole structure 100 to a second end 166 at the posterior end 20 of the sole structure 100. The chassis 108 further includes a top surface 168 defining a portion of a footbed, and a bottom surface 170 formed on the opposite side of the chassis 108 than the top surface 168 and configured to interface with the top side 114 of the bladder 106.

The chassis 108 includes a plurality of projections 172*a*-172*c* formed on the bottom surface 170. Here, a shape each of the projections 172*a*-172*c* corresponds to a shape one of the upper pockets 158*a*-158*c* formed in the bladder 106, such that when the chassis 108 is assembled with the bladder 106, one of the projections 172*a*-172*c* is received within a respective one of the upper pockets 158*a*-158*c*. In the illustrated example, the projections 172*a*-172*c* are configured to fully extend into the upper pockets 158*a*-158*c* when the midsole 102 is assembled. Thus, distal ends 174*a*-174*c* of each of the projections 172*a*-172*c* contact the web area 120. In other examples, one or more of the projections 172*a*-172*c* may be configured so that the distal ends 174*a*-174*c* are spaced apart from the web area 120, or may be omitted from the chassis.

As described above, the chassis 108 is formed of a resilient polymeric material, such as foam or rubber, to impart properties of cushioning, responsiveness, and energy distribution to the foot of the wearer. The chassis 108 may independently be formed from a single unitary piece of resilient polymeric material, or may be formed of a plurality of elements each formed of one or more resilient polymeric materials. For example, the plurality of elements may be affixed to each other using a fusing process, using an adhesive, or by suspending the elements in a different resilient polymeric material. Alternatively, the plurality of elements may not be affixed to each other, but may remain independent while contained in one or more structures forming the cushioning element. In this alternative example, the plurality of independent cushioning elements may be a plurality of foamed particles, and may contained in a bladder or shell structure. As such, the cushioning element may be formed of a plurality of foamed particles contained within a relatively translucent bladder or shell formed of a film such as a barrier membrane.

Example resilient polymeric materials for the chassis may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., cross-linked polyurethanes and/or thermoplastic polyurethanes). Examples of suitable polyurethanes include those discussed above for barrier layers 118. Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as adodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a cross-linking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

In some examples, the outsole 104 extends over the midsole 102 to provide increased durability and resiliency. In the illustrated example, the outsole 104 is provided as a polymeric layer that is overmolded onto the bladder 106 to provide increased durability to the exposed portions of the lower barrier layer 118 of the bladder 106. Accordingly, the outsole 104 is formed of a different material than the bladder 106, and includes at least one of a different thickness, a different hardness, and a different abrasion resistance than the lower barrier layer 118. In some examples, the outsole 104 may be formed integrally with the lower barrier layer 118 of the bladder 106 using an overmolding process. In other examples, the outsole 104 may be formed separately from the lower barrier layer 118 of the bladder 106 and may be adhesively bonded to the lower barrier layer 118.

The upper 200 is attached to the sole structure 100 and includes interior surfaces that define an interior void configured to receive and secure a foot for support on sole structure 100. The upper 200 may be formed from one or more materials that are stitched or adhesively bonded together to form the interior void. Suitable materials of the upper may include, but are not limited to, mesh, textiles, foam, leather, and synthetic leather. The materials may be selected and located to impart properties of durability, air-permeability, wear-resistance, flexibility, and comfort.

The following Clauses provide exemplary configurations for a bladder, a sole structure, and an article of footwear described above.

Clause 1. A bladder comprising a first chamber having a substantially U-shape and a second chamber having a substantially U-shape and being spaced apart from the first chamber in a direction extending along a longitudinal axis of the bladder.

Clause 2. The bladder of Clause 1, wherein the first chamber and the second chamber are in fluid communication with one another.

Clause 3. The bladder of any of the preceding Clauses, wherein the first chamber is aligned with the second chamber.

Clause 4. The bladder of any of the preceding Clauses, wherein the first chamber includes a first leg and a second leg joined by a first arcuate segment and the second chamber includes a third leg and a fourth leg joined by a second arcuate segment.

Clause 5. The bladder of Clause 4, wherein the first leg, the second leg, the third leg, and the fourth leg extend in the same direction.

Clause 6. The bladder of Clause 4 or Clause 5, wherein the first leg and the second leg are disposed between the first arcuate segment and the second arcuate segment.

Clause 7. The bladder of any of Clauses 4-6, wherein at least one of the first leg, the second leg, the third leg, and the fourth leg is elongate.

Clause 8. The bladder of any of Clauses 4-7, further comprising a third chamber extending between the first leg and the second leg in a direction toward the first arcuate segment.

Clause 9. The bladder of Clause 8, wherein the third chamber is spaced apart from the first leg and the second leg.

Clause 10. The bladder of any of Clauses 4-9, further comprising a fourth chamber extending between the third leg and the fourth leg in a direction toward the second arcuate segment.

Clause 11. The bladder of Clause 10, wherein the fourth chamber is spaced apart from the third leg and the fourth leg.

Clause 12. The bladder of Clause 10 or Clause 11, wherein at least one of the third chamber and the fourth chamber is elongate.

Clause 13. The bladder of any of the preceding Clauses, further comprising a web area defining the first chamber and the second chamber.

Clause 14. The bladder of Clause 13, wherein the web area includes a first portion having a substantially U-shape and a second portion having a substantially U-shape.

Clause 15. An article of footwear incorporating the bladder of any of the preceding Clauses.

Clause 16. A bladder comprising a first chamber, a second chamber spaced apart from the first chamber in a direction extending along a longitudinal axis of the bladder, and a web area defining the first chamber and the second chamber and including a first portion having a substantially U-shape and a second portion having a substantially U-shape.

Clause 17. The bladder of Clause 16, wherein the first chamber and the second chamber are in fluid communication with one another.

Clause 18. The bladder of Clause 16, wherein the first chamber includes a substantially U-shape and the second chamber includes a substantially U-shape, the first chamber being aligned with the second chamber.

Clause 19. The bladder of any of the preceding Clauses, wherein the first chamber includes a first leg and a second leg joined by a first arcuate segment and the second chamber includes a third leg and a fourth leg joined by a second arcuate segment.

Clause 20. The bladder of Clause 19, wherein the first leg, the second leg, the third leg, and the fourth leg extend in the same direction.

Clause 21. The bladder of Clause 19 or Clause 20, wherein the first leg and the second leg are disposed between the first arcuate segment and the second arcuate segment.

Clause 22. The bladder of any of Clauses 19-21, wherein at least one of the first leg, the second leg, the third leg, and the fourth leg is elongate.

Clause 23. The bladder of any of Clauses 19-22, further comprising a third chamber extending between the first leg and the second leg in a direction toward the first arcuate segment.

Clause 24. The bladder of Clause 23, wherein the third chamber is spaced apart from the first leg and the second leg.

Clause 25. The bladder of any of Clauses 19-24, further comprising a fourth chamber extending between the third leg and the fourth leg in a direction toward the second arcuate segment.

Clause 26. The bladder of Clause 25, wherein the fourth chamber is spaced apart from the third leg and the fourth leg.

Clause 27. The bladder of Clause 25 or Clause 26, wherein at least one of the third chamber and the fourth chamber is elongate.

Clause 28. An article of footwear incorporating the bladder of any of the preceding Clauses.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A bladder comprising:

a first chamber having a substantially U-shape and including a first medial leg and a first lateral leg, at least one of the first medial leg and the first lateral leg including a first lobe and a second lobe separated from the first lobe by a first depression defined by a portion of the at least one of the first medial leg and the first lateral leg extending between the first lobe and the second lobe, the first depression having a smaller cross-sectional area than the first lobe and the second lobe, the first chamber defining a rear-most point of the bladder;

a second chamber directly fluidly coupled to the first medial leg and the first lateral leg and having a second medial leg and a second lateral leg, at least one of the second medial leg and the second lateral leg including a third lobe aligned with at least one of the first lobe and the second lobe; and a third chamber having a substantially U-shape and directly fluidly coupled to the second medial leg and the second lateral leg, the second chamber extending longitudinally between the first chamber and the third chamber, the third chamber defining a front-most point of the bladder.

2. The bladder of claim 1, wherein the second chamber includes a substantially U-shape.

3. The bladder of claim 2, wherein the second chamber is positioned forwardly from the first chamber in a direction extending along a longitudinal axis of the bladder.

4. The bladder of claim 2, wherein the third chamber includes a third medial leg and a third lateral leg.

5. The bladder of claim 1, wherein the second chamber is smaller than the first chamber and larger than the third chamber.

6. The bladder of claim 1, wherein the third chamber includes a third medial leg and a third lateral leg.

7. The bladder of claim 1, wherein the third lobe is separated from the at least one of the first lobe and the second lobe by a second depression having a smaller cross-sectional area than the third lobe and the at least one of the first lobe and the second lobe.

8. The bladder of claim 7, wherein the first lobe, the second lobe, and the third lobe are formed from a unitary sheet of material.

9. A sole structure incorporating the bladder of claim 1.

10. An article of footwear incorporating the bladder of claim 1.

11. A bladder comprising:

a first chamber having a substantially U-shape and including a first medial leg and a first lateral leg, at least one of the first medial leg and the first lateral leg including a first lobe and a second lobe separated from the first lobe by a first depression defined by a portion of the at least one of the first medial leg and the first lateral leg extending between the first lobe and the second lobe, the first depression having a smaller cross-sectional area than the first lobe and the second lobe, the first chamber defining a rear-most point of the bladder;

a second chamber directly fluidly coupled to the first medial leg and the first lateral leg, and having a second medial leg, a second lateral leg, and an interior chamber extending in an opposite direction than the second medial leg and the second lateral leg, the interior chamber disposed between the first medial leg and the first lateral leg; and a third chamber having a substantially U-shape and directly fluidly coupled to the second medial leg and the second lateral leg, the second chamber extending longitudinally between the first chamber and the third chamber, the third chamber defining a front-most point of the bladder.

12. The bladder of claim 11, wherein the second chamber includes a substantially U-shape.

13. The bladder of claim 12, wherein the second chamber is positioned forwardly from the first chamber in a direction extending along a longitudinal axis of the bladder.

14. The bladder of claim 12, wherein the third chamber includes a third medial leg and a third lateral leg.

15. The bladder of claim 11, wherein the second chamber is smaller than the first chamber and larger than the third chamber.

16. The bladder of claim 11, wherein the third chamber includes a third medial leg and a third lateral leg.

17. The bladder of claim 11, wherein the second chamber includes an arcuate segment extending between and joining the second medial leg and the second lateral leg.

18. The bladder of claim 17, wherein the interior chamber extends from the arcuate segment.

19. A sole structure incorporating the bladder of claim 11.

20. An article of footwear incorporating the bladder of claim 11.

* * * * *